US005899122A

United States Patent [19]

Court

[11] Patent Number: 5,899,122

[45] Date of Patent: May 4, 1999

[54] ELECTRICALLY POWERED CORKSCREW

[76] Inventor: Donald W Court, 168 Dundas St. East, Mississauga, Ontario, Canada, L5A 1W4

[21] Appl. No.: 08/857,729

[22] Filed: May 16, 1997

[51] Int. Cl.[6] ..... B67B 7/00

[52] U.S. Cl. ..... 81/3.2; 81/3.36; 81/3.45

[58] Field of Search ..... 81/3.2, 3.36, 3.29, 81/3.39, 3.45, 3.48

[56] References Cited

U.S. PATENT DOCUMENTS

| | | | |
|---|---|---|---|
| 778,112 | 12/1904 | Church et al. | 81/3.39 |
| 4,171,650 | 10/1979 | Cardinal | 81/3.2 |
| 4,766,780 | 8/1988 | Sechen | 81/3.2 |
| 5,095,778 | 3/1992 | Bocsi et al. | 81/3.2 |
| 5,167,172 | 12/1992 | Heebner | 81/3.2 |
| 5,203,236 | 4/1993 | Anderson | 81/3.2 |
| 5,271,296 | 12/1993 | Parent et al. | 81/3.2 |
| 5,351,579 | 10/1994 | Metz et al. | 81/3.2 |
| 5,372,054 | 12/1994 | Federighi, Sr. | 81/3.2 |
| 5,617,765 | 4/1997 | Bennett | 81/3.2 |
| 5,647,251 | 7/1997 | Hardman | 81/3.2 |

*Primary Examiner*—David A. Scherbel
*Assistant Examiner*—Joni B. Danganan

[57] ABSTRACT

A new electrically powered corkscrew for aiding in the removal of corks from bottles, such as wine bottles. The inventive device includes a bottle holding unit which supports a bottle thereon and a corkscrew spiral mounted on the holding unit for both rotary motion and longitudinal movement. A first electric motor is coupled to the spiral for rotating the spiral, and a second electric motor is coupled to the spiral for longitudinally moving the spiral. Operation of the motors is controlled by a control unit for operating the spiral to at least partially removing the cork from the bottle.

19 Claims, 3 Drawing Sheets

13
55
3
15
20
18
17
16
54
14

10
55
56
3
13
15
20
21
18
19
17
53
12
16
14
54
22
6
6

ELECTRICALLY POWERED CORKSCREW

BACKGROUND OF THE INVENTION

1. Field of the Invention

The present invention relates to corkscrews and more particularly pertains to a new electrically powered corkscrew for aiding in the removal of corks from bottles, such as wine bottles.

2. Description of the Prior Art

The use of corkscrews is known in the prior art. More specifically, corkscrews heretofore devised and utilized are known to consist basically of familiar, expected and obvious structural configurations, notwithstanding the myriad of designs encompassed by the crowded prior art which have been developed for the fulfillment of countless objectives and requirements.

Known prior art corkscrews include U.S. Pat. No. 5,351,579; U.S. Pat. No. 5,095,778; U.S. Pat. No. 4,955,261; U.S. Pat. No. 4,637,283; U.S. Pat. No. 5,079,975; and U.S. Pat. No. Des. 358,744.

While these devices fulfill their respective, particular objectives and requirements, the aforementioned patents do not disclose a new electrically powered corkscrew. The inventive device includes a bottle holding unit which supports a bottle thereon and a corkscrew spiral mounted on the holding unit for both rotary motion and longitudinal movement. A first electric motor is coupled to the spiral for rotating the spiral, and a second electric motor is coupled to the spiral for longitudinally moving the spiral.

In these respects, the electrically powered corkscrew according to the present invention substantially departs from the conventional concepts and designs of the prior art, and in so doing provides an apparatus primarily developed for the purpose of aiding in the removal of corks from bottles, particularly wine bottles.

SUMMARY OF THE INVENTION

In view of the foregoing disadvantages inherent in the known types of corkscrews now present in the prior art, the present invention provides a new electrically powered corkscrew construction wherein the same can be utilized for aiding in the removal of corks from bottles, such as wine bottles.

The general purpose of the present invention, which will be described subsequently in greater detail, is to provide a new electrically powered corkscrew apparatus and method which has many of the advantages of the corkscrews mentioned heretofore and many novel features that result in a new electrically powered corkscrew which is not anticipated, rendered obvious, suggested, or even implied by any of the prior art corkscrews, either alone or in any combination thereof.

To attain this, the present invention generally comprises a bottle holding unit which supports a bottle thereon and a corkscrew spiral mounted on the holding unit for both rotary motion and longitudinal movement. A first electric motor is coupled to the spiral for rotating the spiral, and a second electric motor is coupled to the spiral for longitudinally moving the spiral.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new electrically powered corkscrew apparatus and method which has many of the advantages of the corkscrews mentioned heretofore and many novel features that result in a new electrically powered corkscrew which is not anticipated, rendered obvious, suggested, or even implied by any of the prior art corkscrews, either alone or in any combination thereof.

It is another object of the present invention to provide a new electrically powered corkscrew which may be easily and efficiently manufactured and marketed.

It is a further object of the present invention to provide a new electrically powered corkscrew which is of a durable and reliable construction.

An even further object of the present invention is to provide a new electrically powered corkscrew which is susceptible of a low cost of manufacture with regard to both materials and labor, and which accordingly is then susceptible of low prices of sale to the consuming public, thereby making such electrically powered corkscrew economically available to the buying public.

Still yet another object of the present invention is to provide a new electrically powered corkscrew which provides in the apparatuses and methods of the prior art some of the advantages thereof, while simultaneously overcoming some of the disadvantages normally associated therewith.

Still another object of the present invention is to provide a new electrically powered corkscrew for aiding in the removal of corks from bottles, such as wine bottles.

Yet another object of the present invention is to provide a new electrically powered corkscrew which includes a bottle holding unit which supports a bottle thereon and a corkscrew spiral mounted on the holding unit for both rotary motion and longitudinal movement. A first electric motor is coupled to the spiral for rotating the spiral, and a second electric motor is coupled to the spiral for longitudinally moving the spiral.

Still yet another object of the present invention is to provide a new electrically powered corkscrew that quickly and easily removes the cork from the bottle.

Even still another object of the present invention is to provide a new electrically powered corkscrew that eliminates the aggravation of broken corks and spillage.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
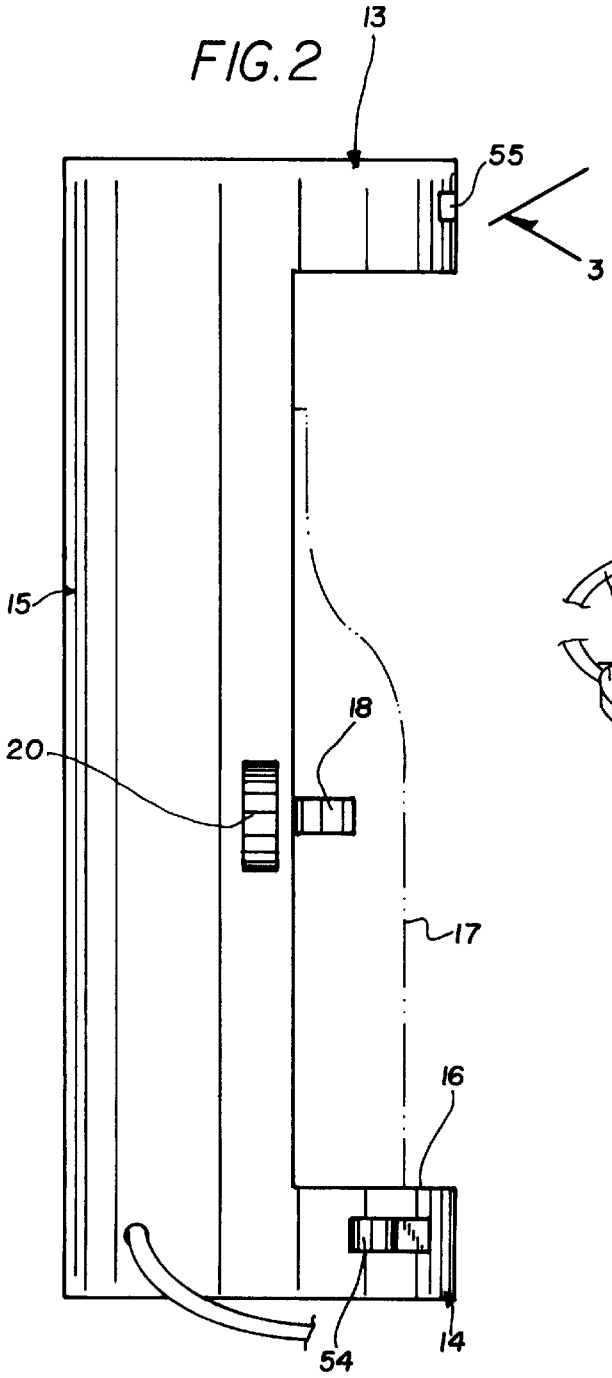
FIG. 2 is a side view of the present invention.

With reference now to the drawings, and in particular to FIGS. 1 through 6 thereof, a new electrically powered corkscrew embodying the principles and concepts of the present invention and generally designated by the reference numeral 10 will be described.

Figure 1:
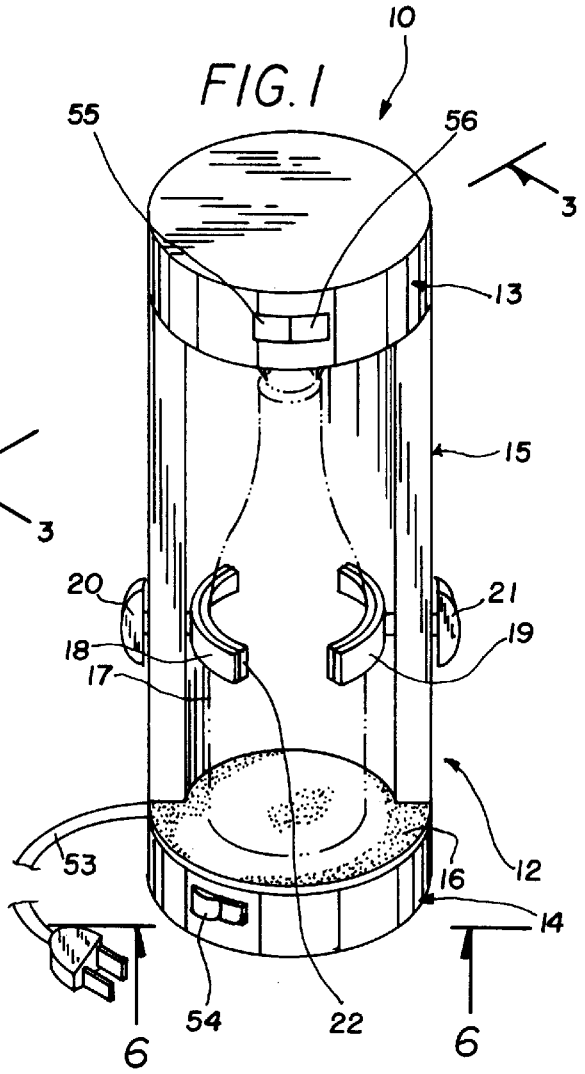
FIG. 1 is a perspective view of a new electrically powered corkscrew according to the present invention.

As best illustrated in FIGS. 1 through 6, the electrically powered corkscrew 10 comprises a bottle holding unit 12 having a top portion 13, a bottom portion 14, and a wall 15 extending between the top and bottom portions. The top and bottom portions 13,14 are generally circular and the wall 15 is semi-cylindrical and attached to the outer portions of the portions 13,14. The bottom portion 14 defines an upward facing support surface 16 for supporting the bottle 17 (illustrated in dashed lines) thereon. The surface 16 is preferably formed of a non-slip material, such as foam rubber, to prevent slippage of the bottle. As illustrated in FIGS. 1 and 2, the unit 12 is shaped and sized such that the bottle is partially surrounded by the wall 15 when it is supported by the surface 16, and the top of the bottle is located below the top portion 13.

As best illustrated in FIG. 1, the wall 15 includes arcuate clamping members 18,19 adjacent opposite edges of the wall 15 such that they are disposed on opposite sides of the bottle 17. The members 18,19 are coupled with threaded thumb screws 20,21 disposed through suitable threaded apertures provided in the wall 15. The members 18,19 and screws 20,21 are coupled such that rotation of the screws results in radial inward movement of the members. A suitable coupling includes threaded posts extending from the members which are disposed within threaded sleeves of the screws, similar to a jackscrew-type device. Thus it is seen that by turning the screws 20,21 in one direction, the members are moved inward into engagement with the bottle to securely clamp it, and when the screws are turned in the opposite direction, the members move away from the bottle so that it may be removed from the holding unit. The inner surfaces of the members 18,19 are provided with a non-slip lining 22, such as rubber, in order to prevent slipping of the bottle relative to the members and to prevent marring of the glass bottle.

Figure 3:
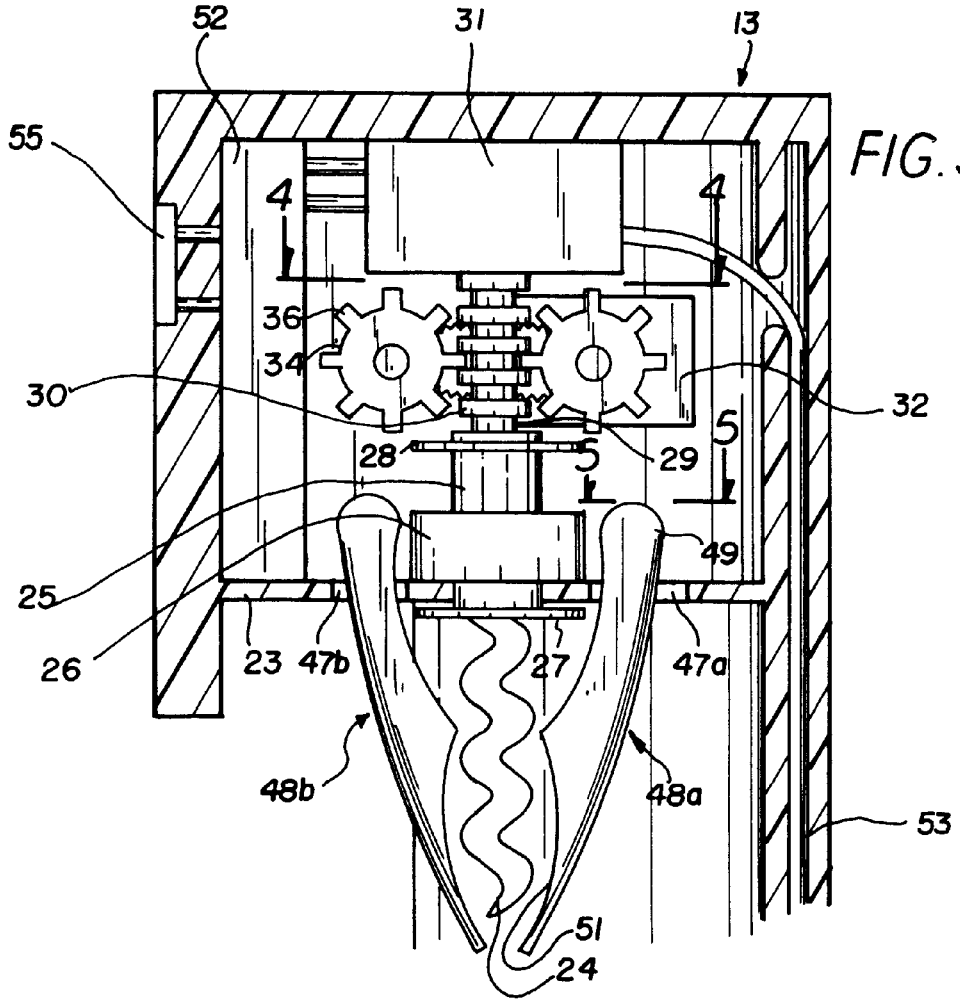
FIG. 3 is a cross sectional view taken along line 3—3 of FIG. 1.

Turning now to FIG. 3, the top portion 13 is illustrated as being generally hollow. A wall 23 defines the bottom of the hollow top portion. A corkscrew spiral 24 is mounted to the top portion 13 for both rotary and longitudinal movements relative thereto. The spiral 24 is affixed to the bottom end of a drive shaft 25 which extends through a suitable hole in the wall 23. Stationary collar 26 is mounted on the wall 23 to rotatably and slidably support the shaft 25 which extends therethrough, and to stabilize the shaft. A pair of stop collars 27,28 are connected to the drive shaft to define the extent of longitudinal movement of the shaft. The bottom stop collar 27 abuts the wall 23 at the uppermost extent of motion, while the top collar 28 abuts the top of the stationary collar 26 to define the lowermost extent of motion.

The top portion of the drive shaft 25 is provided with a series of alternating grooves 29 and flanges 30, the purpose of which will become apparent later, and extends into a first electric motor 31 for rotating the shaft 25. The motor 31 is configured such that it is able to cause rotation of the shaft while permitting axial movements of the shaft therewithin. Thus the motor 31 rotates the shaft 25 which in turn causes rotation of the spiral 24. The motor 31 is also reversible so that the spiral can be rotated in either direction.

Figure 4:
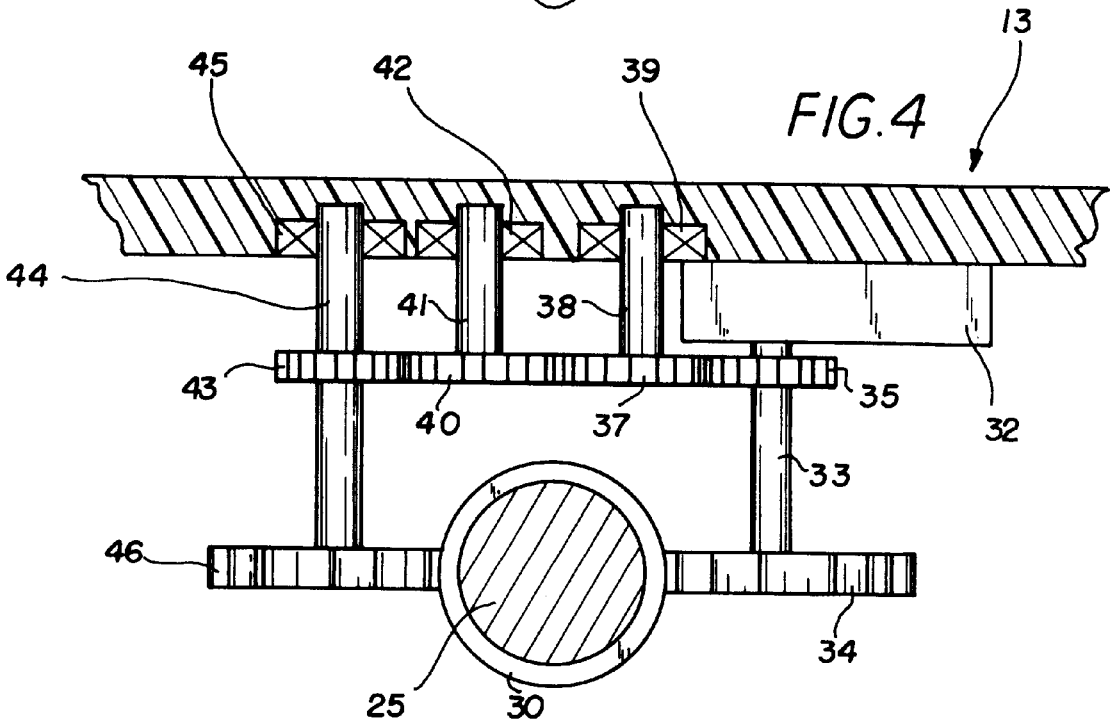
FIG. 4 is a partial cross sectional view taken along line 4—4 of FIG. 3.
Figure 5:
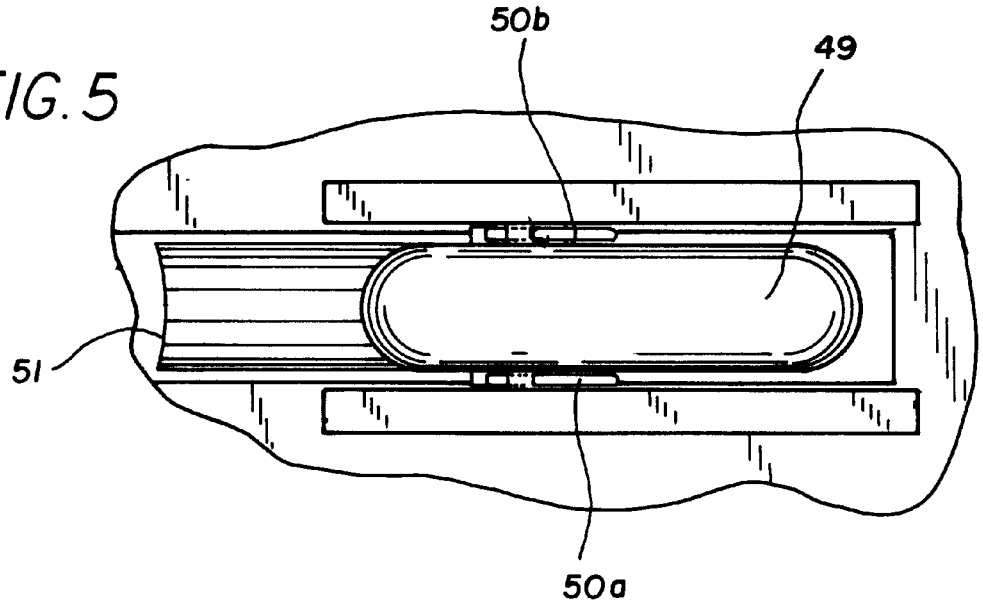
FIG. 5 is a view taken along line 5—5 of FIG. 3.
Figure 6:
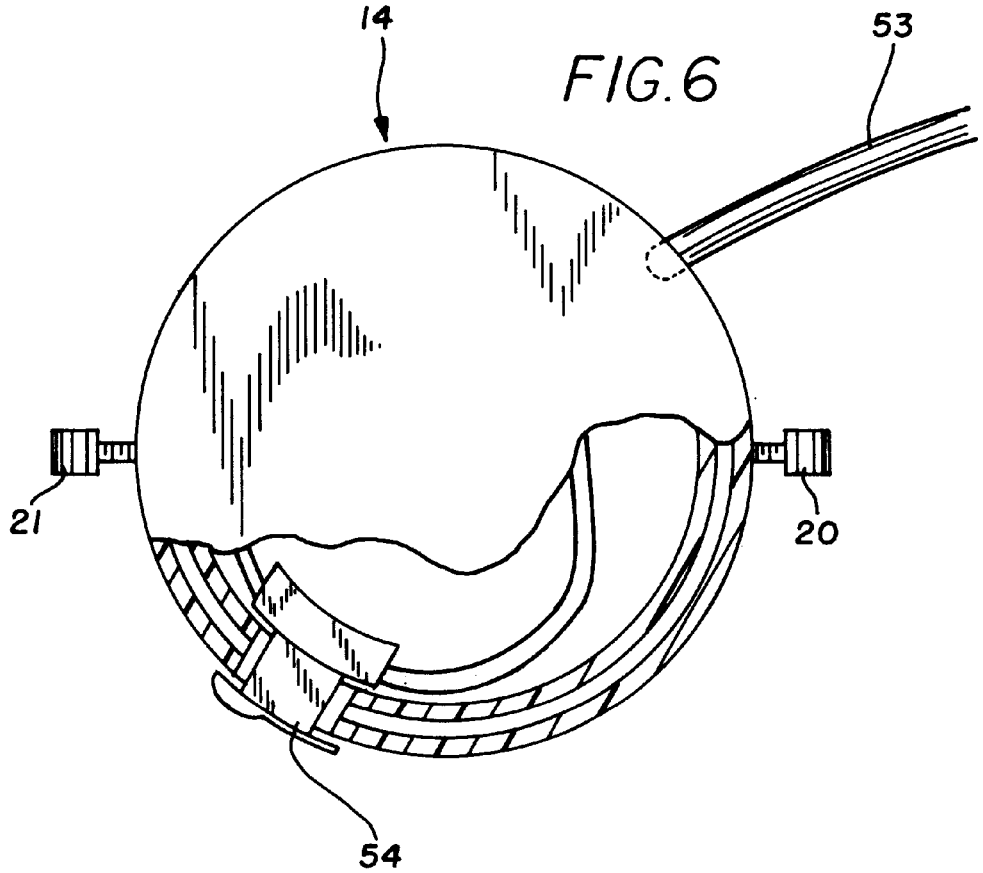
FIG. 6 is a partial sectional view taken along line 6—6 of FIG. 1.

In order to longitudinally move the shaft 25, a second, reversible electric motor 32 is mounted within the hollow interior of the top portion and is coupled to the shaft 25. Referring in particular to FIGS. 3 and 4, the motor 32 rotates an output shaft 33 having a pair of gears 34,35 mounted thereon. The gear 34 is disposed on one side of the shaft 25 for engagement therewith, and includes a plurality of teeth 36 thereon which are sized for engagement within the grooves 29. The gear 35, on the other hand, engages with a first intermediate gear 37 secured to a shaft 38 which is rotationally supported in a wall of the top portion 13 by a bearing 39. The gear 37 meshes with a second intermediate gear 40 having a shaft 41 rotationally supported by bearing 42, which in turn meshes with a third intermediate gear 43. The gear 43 is mounted on a shaft 44 having one end supported by bearing 45 in the wall, and having a drive gear 46 mounted at the opposite end. The gear 46 is identical to the gear 34, but engages with the side of the shaft opposite the gear 34.

The shaft 25 is thus caused to move longitudinally by rotation of the motor 32 which rotates the gears 34,35. Rotation of the gear 35 results in rotation of the gear 46 in the direction opposite to the rotation direction of gear 34, so that both gears 34,46 engage the shaft and cause it to move either up or down, depending upon the rotation direction of the shaft 33. Note that the teeth 36 in the grooves 29 permits rotation of the shaft relative to the gears 34,46, but cause upward or downward movement of the shaft when the gears 34,46 are rotated.

Additionally, the wall 23 includes a pair of apertures 47*a,b* therein, through which extend cutting blades 48*a,b* for cutting a wrapper which is normally disposed around the mouth of the bottle and over the cork. Each blade is identical, so only the blade 48*a* will be described in detail. The blade 48*a* includes a first end 49 pivotally secured within the hollow top portion 13, with tension springs

50*a*,50*b* engaged with opposite sides of the end 49 for biasing the blade 48*a* in a first direction. The blade 48*a* further includes a cutting end 51 which is sharpened so as to cut the wrapper. The blades 48*a,b* are located such that they engage the top end of the bottle when the bottle is mounted on the holding unit 12, and upon relative rotation of the bottle and blades, the wrapper is cut so that the cork is able to be removed from the bottle. The bias of the springs ensures that the cutting ends 51 engage with the wrappers on different size bottles.

Operation of the apparatus 10 is controlled by a control unit 52 disposed within the top portion. The control unit 52 is connected to the motors 31,32 for controlling their operation. Electrical power for the unit 52 and motors is provided by a power cord 53 which extends into the bottom portion 14, up through the wall 15, and to the top portion 13. The bottom portion includes an on-off switch 54 mounted thereon for controlling the supply of power to the apparatus 10. The top portion 13 further includes red and green indicator lights 55,56 thereon controlled by the control unit 52, to indicate the op The contrition of the apparatus 10.

The control unit 52 is preferably programmed, and the spiral 24 and shaft 25 configured, such that when the apparatus 10 is turned on, the spiral 24 is rotated by the motor 31 and caused to descend by the motor 32 until the spiral is about ¾ of the way through the cork, at which point the motor 31 is stopped to stop rotation of the spiral. The unit 52 will then reverse the motor 32 so as to move the spiral upward. The cork will be pulled upward with the spiral a distance approximately equal to the downward movement distance of the spiral, at which point the motor 32 is stopped. The motor 31 is then actuated to rotate the spiral in a reverse direction to remove the spiral from the cork. Thus the cork is left in the bottle a certain distance with a portion of the top of the cork extending from the bottle. The cork can then be easily removed by hand when desired. During this operation, the red light will be activated as a warning not to remove the bottle since the spiral is engaged with the cork. The green light is activated to indicate that the spiral is removed from the cork, and that it is then safe to remove the bottle. Instead of partially removing the cork, the apparatus 10 could be configured to completely remove the cork if desired.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An electric corkscrew apparatus for removing a cork from a bottle, comprising:

a bottle holding unit having a support surface for supporting the bottle thereon;

a corkscrew spiral mounted on the bottle holding unit at a location spaced above said support unit, said corkscrew spiral being adapted for both rotary movement and longitudinal movement relative to said bottle holding unit for facilitating rotary insertion of said corkscrew spiral into said cork and longitudinal removal of said cork from said bottle;

a first motor means coupled to the corkscrew spiral by first coupling means for rotating the corkscrew spiral;

a second motor means coupled to the corkscrew spiral by second coupling means for longitudinally moving the corkscrew spiral relative to the bottle holding unit; and cutter means for cutting a wrapper which covers the top of the bottle and the cork, said cutter means comprising a pair of cutting blades, each blade having a first end pivotally secured within a top portion of the holding unit, each blade having a cutting end opposite said first end, and each blade having tension springs engaged to opposite sides of said first end to bias said cutting end into contact with a top of said bottle.

2. The electric corkscrew apparatus of claim 1, wherein said first and second motor means comprise electric motors.

3. The electric corkscrew apparatus of claim 1, wherein said bottle holding unit includes bottle gripping means connected thereto for gripping an intermediate portion of the bottle.

4. The electric corkscrew apparatus of claim 3, wherein said bottle gripping means comprises a pair of arcuate clamp members connected to the bottle holding unit such that they are disposed on opposite sides of the bottle when the bottle is supported by the bottle holding unit.

5. The electric corkscrew apparatus of claim 4, wherein each of said clamp members is coupled to a respective one of a pair of manually actuated, threaded members for selectively moving each said clamp member into and out of engagement with said bottle such that said bottle is adjustably positionable along a line perpendicular to a longitudinal axis of the bottle holding unit for facilitating alignment of said corkscrew spiral with said cork, said clamp members being located at a position spaced above said support surface to thereby clamp a middle portion of a bottle.

6. The electric corkscrew apparatus of claim 1, wherein said first motor means rotates the corkscrew spiral in both forward and reverse directions.

7. The electric corkscrew apparatus of claim 1, wherein said second motor means moves the corkscrew spiral both upward and downward relative to the bottle holding unit.

8. The electric corkscrew apparatus of claim 1, further including a control unit for controlling operation of both the first and second motor means.

9. The electric corkscrew apparatus of claim 1, wherein said first coupling means comprises a shaft between the first motor means and the corkscrew spiral.

10. The electric corkscrew apparatus of claim 9, wherein said second coupling means comprises gears driven by the second motor means and in engagement with the shaft.

11. The electric corkscrew apparatus of claim 9, further comprising stop means formed on the shaft for limiting the longitudinal movement of the corkscrew spiral.

12. An electric corkscrew apparatus for removing a cork from a bottle, comprising:

a bottle holding unit having a support surface for supporting the bottle thereon;

a corkscrew spiral mounted on the bottle holding unit for both rotary movement and longitudinal movement relative thereto;

a first motor means coupled to the corkscrew spiral by first coupling means for rotating the corkscrew spiral;

a second motor means coupled to the corksrew spiral by second coupling means for longitudinally moving the corkscrew spiral relative to the bottle holding unit;

wherein said first and second motor means comprise electric motors;

cutter means for cutting a wrapper which covers the top of the bottle and the cork, said cutter means comprising a pair of cutting blades, each blade having a first end pivotally secured within a top portion of the holding unit, each blade having a cutting end opposite said first end, and each blade having tension springs engaged to opposite sides of said first end to bias said cutting end into contact with a top of said bottle;

wherein said bottle holding unit includes bottle gripping means connected thereto for gripping an intermediate portion of the bottle;

wherein said bottle gripping means comprises a pair of arcuate clamp members connected to the bottle holding unit such that they are disposed on opposite sides of the bottle when the bottle is supported by the bottle holding unit;

wherein each said clamp member is coupled to a respective one of a pair of manually actuated, threaded members for selectively moving each said clamp member into and out of engagement with said bottle such that said bottle is adjustably positionable along a line perpendicular to a longitudinal axis of the bottle holding unit for facilitating alignment of said corkscrew spiral with said cork;

wherein said first motor means rotates the corkscrew spiral in both forward and reverse directions;

wherein said second motor means moves the corkscrew spiral both upward and downward relative to the bottle holding unit;

a control unit for controlling operation of both the first and second motor means;

wherein said first coupling means comprises a shaft between the first motor means and the corkscrew spiral;

wherein said second coupling means comprises gears driven by the second motor means and in engagement with the shaft; and stop means formed on the shaft for limiting the longitudinal movement of the corkscrew spiral;

wherein said corkscrew spiral comprises a shaft having a plurality of annular ribs, said first motor means comprising a motor for rotating said shaft, and said second motor means comprising a pair of spaced gears interlocking with said annular ribs of said shaft for shifting the longitudinal position of said shaft and said corkscrew spiral when said spaced gears are rotated, said shaft being rotatable at all longitudinal positions.

13. An electric corkscrew apparatus of claim 1 for removing a cork from a bottle, comprising:

a bottle holding unit having a support surface for supporting the bottle thereon;

a corkscrew spiral mounted on the bottle holding unit at a location spaced above said support unit, said corkscrew spiral being adapted for both rotary movement and longitudinal movement relative to said bottle holding unit for facilitating rotary insertion of said corkscrew spiral into said cork and longitudinal removal of said cork from said bottle;

a first motor means coupled to the corkscrew spiral by first coupling means for rotating the corkscrew spiral; and a second motor means coupled to the corkscrew spiral by second coupling means for longitudinally moving the corkscrew spiral relative to the bottle holding unit;

wherein said corkscrew spiral comprises a shaft having a plurality of annular ribs, said first motor means comprising a motor for rotating said shaft, and said second motor means comprising a pair of spaced gears interlocking with said annular ribs of said shaft for shifting the longitudinal position of said shaft and said corkscrew spiral when said spaced gears are rotated, said shaft being rotatable at all longitudinal positions.

14. The electric corkscrew apparatus of claim 13, further comprising cutter means for cutting a wrapper which covers the top of the bottle and the cork, said cutter means comprising a pair of cutting blades, each blade having a first end pivotally secured within a top portion of the holding unit, each blade having a cutting end opposite said first end, and each blade having tension springs engaged to opposite sides of said first end to bias said cutting end into contact with a top of said bottle.

15. The electric corkscrew apparatus of claim 13, wherein said bottle holding unit includes bottle gripping means connected thereto for gripping an intermediate portion of the bottle.

16. The electric corkscrew apparatus of claim 15, wherein said bottle gripping means comprises a pair of arcuate clamp members connected to the bottle holding unit such that they are disposed on opposite sides of the bottle when the bottle is supported by the bottle holding unit.

17. The electric corkscrew apparatus of claim 16, wherein each of said clamp members is coupled to a respective one of a pair of manually actuated, threaded members for selectively moving each said clamp member into and out of engagement with said bottle such that said bottle is adjustably positionable along a line perpendicular to a longitudinal axis of the bottle holding unit for facilitating alignment of said corkscrew spiral with said cork, said clamp members being located at a position spaced above said support surface to thereby clamp a middle portion of a bottle.

18. The electric corkscrew apparatus of claim 13, wherein said first coupling means comprises a shaft between the first motor means and the corkscrew spiral.

19. The electric corkscrew apparatus of claim 18, further comprising stop means formed on the shaft for limiting the longitudinal movement of the corkscrew spiral.

* * * * *